US006978577B2

(12) United States Patent
Jones

(10) Patent No.: US 6,978,577 B2
(45) Date of Patent: Dec. 27, 2005

(54) HEATED ROOF GUTTER ASSEMBLY

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 10/777,944

(22) Filed: Feb. 12, 2004

(65) Prior Publication Data

US 2005/0183343 A1 Aug. 25, 2005

(51) Int. Cl.[7] ..... E04D 13/064
(52) U.S. Cl. ..... 52/11; 248/48.1
(58) Field of Search ..... 52/11–16; 248/48.1, 248/48.2, 65, 73; 219/213

(56) References Cited

U.S. PATENT DOCUMENTS 3,582,612 A * 6/1971 Siemianowski ..... 219/213
3,795,271 A * 3/1974 Adamic ..... 165/47
3,824,749 A * 7/1974 Scherf ..... 52/11
3,989,031 A * 11/1976 Thomason et al. ..... 126/704
4,237,863 A * 12/1980 Harrison ..... 126/585
4,300,319 A * 11/1981 Frost et al. ..... 52/11
4,308,696 A * 1/1982 Schroeder ..... 52/11
RE31,321 E * 7/1983 Harrison ..... 126/585
4,393,859 A * 7/1983 Marossy et al. ..... 126/586
5,123,247 A * 6/1992 Nelson ..... 60/641.8
5,729,947 A * 3/1998 Dawes ..... 52/521
5,878,533 A * 3/1999 Swanfeld, Jr. ..... 52/11
6,403,935 B2 * 6/2002 Kochman et al. ..... 219/545
6,489,594 B2 * 12/2002 Jones ..... 219/213
6,708,452 B1 * 3/2004 Tenute ..... 52/11
6,727,471 B2 * 4/2004 Evans et al. ..... 219/213

* cited by examiner

*Primary Examiner*—Jeanette E Chapman
(74) *Attorney, Agent, or Firm*—Taylor & Aust, P.C.

(57) ABSTRACT

A gutter assembly for use on a roof includes a gutter, a cover over the gutter, and a heater plate disposed under the cover. The cover includes a bottom surface which is at least partially covered with a heat absorbing material. The heater plate carries at least one heater.

11 Claims, 2 Drawing Sheets

HEATED ROOF GUTTER ASSEMBLY

BACKGROUND OF THE INVENTION

1. Field of the Invention

The present invention relates to roof gutters, and, more particularly, to roof gutter assemblies with a cover over a gutter.

2. Description of the Related Art

A common problem associated with gutters positioned along an edge of a roof on a building is that the gutters accumulate debris such as leaves, sticks, etc. This debris may cause the gutter and/or downspout extending from the gutter to become plugged. It is therefore necessary to periodically clean gutters to ensure that the gutter operates correctly.

It is known to provide a cover over a gutter to prevent the accumulation of debris therein. A gutter cover typically includes a rounded nose portion which extends closely adjacent to or slightly past the front edge of the gutter. The surface tension of the water flowing over the cover causes the water to flow around the nose and into the gutter, while debris falls from the nose without entering the gutter.

With a gutter cover as described above, it is possible for ice and/or snow to accumulate on the top surface of the cover. The weight of the ice and snow on the gutter cover can damage the cover and/or gutter. Moreover, the ice and snow can create a "dam" effect causing melted water to flow back under the shingles and through the roof. This is of course highly undesirable.

What is needed in the art is an apparatus and method which may be used in conjunction with a gutter cover for preventing the accumulation of ice and/or snow on the cover.

SUMMARY OF THE INVENTION

The present invention provides a roof gutter assembly with a heater positioned below a cover over the gutter. The bottom of the cover is at least partially covered with a heat absorbing material to radiate heat to the top side of the cover where snow and/or ice may accumulate.

The invention comprises, in one form thereof, a gutter assembly for use on a roof, including a gutter, a cover over the gutter, and a heater plate disposed under the cover. The cover includes a bottom surface which is at least partially covered with a heat absorbing material. The heater plate carries at least one heater.

An advantage of the present invention is that the cover is heated from the bottom side to inhibit accumulation of ice and snow.

Another advantage is that the heat absorbing material which covers the bottom side of the cover conducts and radiates heat to the top side of the cover where the snow and/or ice may accumulate.

Yet another advantage is that the top side of the heater plate may also be covered with a heat absorbing material.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
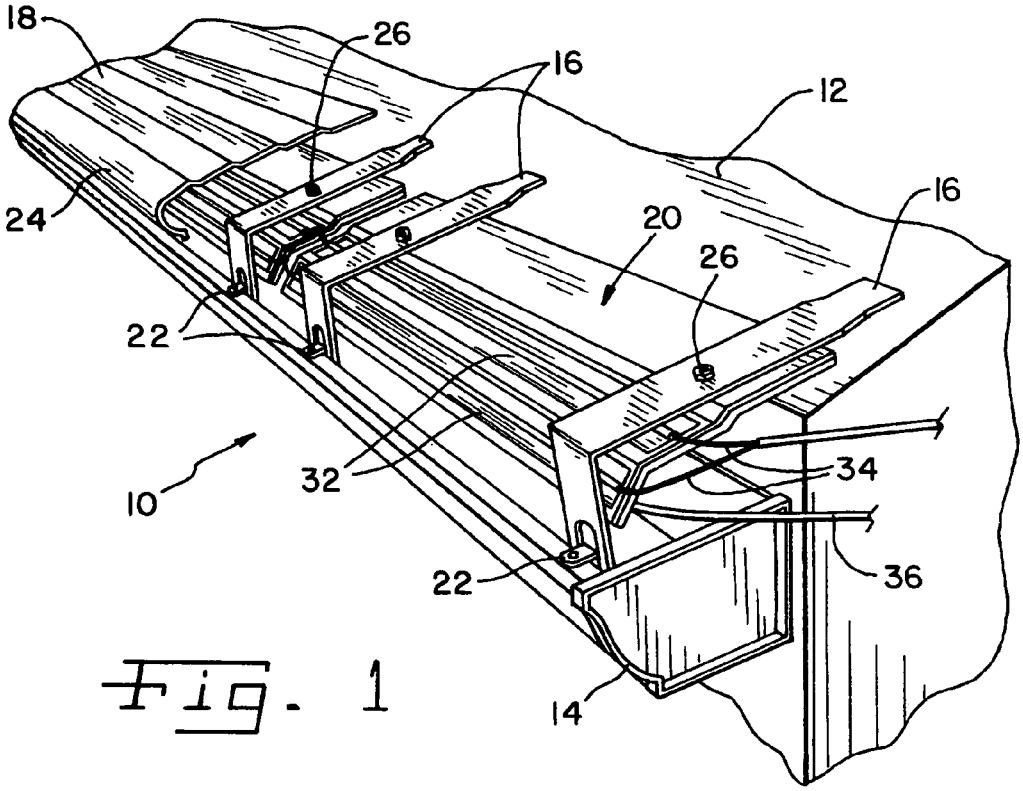
FIG. 1 is a fragmentary, isometric view of an embodiment of a gutter assembly of the present invention.
Figure 2:
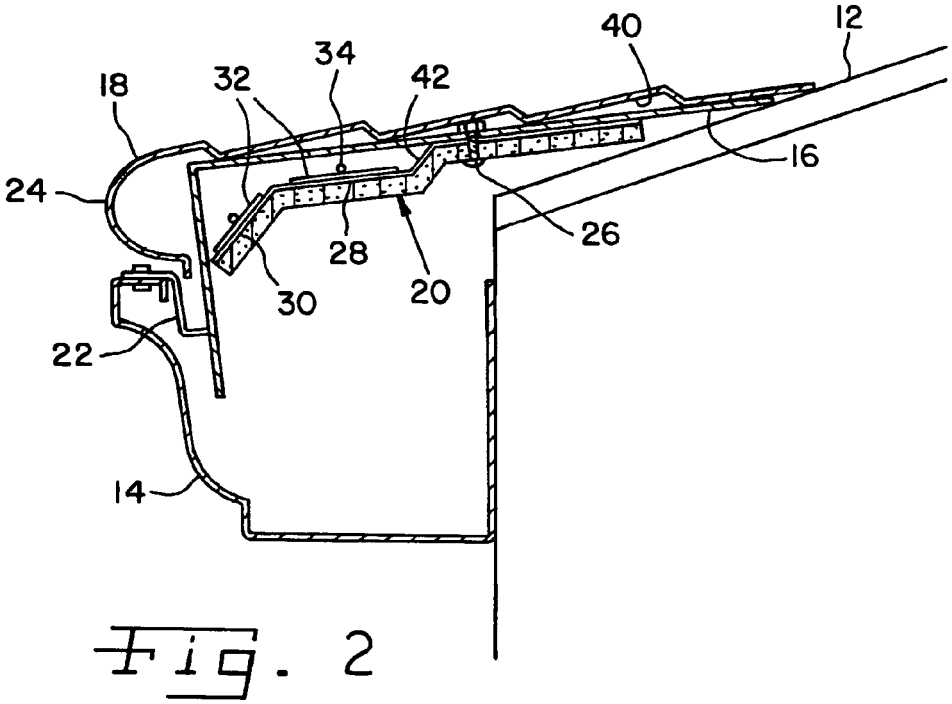
FIG. 2 is an end view of the gutter assembly shown in FIG. 1.

Referring now to the drawings, and more particularly to FIGS. 1 and 2, there is shown an embodiment of gutter assembly 10 of the present invention for use on a roof 12. Gutter assembly 10 generally includes a gutter 14, a plurality of mounting brackets 16, cover 18 and heater plate 20.

Gutter 14 may be of any suitable type, such as metal, plastic, seamless, etc. Gutter 14 is typically a conventional gutter to which mounting brackets 16 and cover 18 are attached.

Mounting brackets 16 have a generally L-shaped configuration. Mounting brackets 16 are attached at one end via clips 22 to gutter 14, and are attached at an opposite end to roof 12. Mounting brackets 16 typically underlie a row of shingles or other suitable roofing material at roof 12.

Cover 18 is mounted to mounting brackets 16, and is positioned over gutter 14. Cover 18 includes a nose 24 around which water flows via surface tension and falls into gutter 14. On the other hand, debris such as leaves, sticks, etc. merely falls from the distal end of nose 24 to the ground without being deposited in gutter 14.

Figure 3:
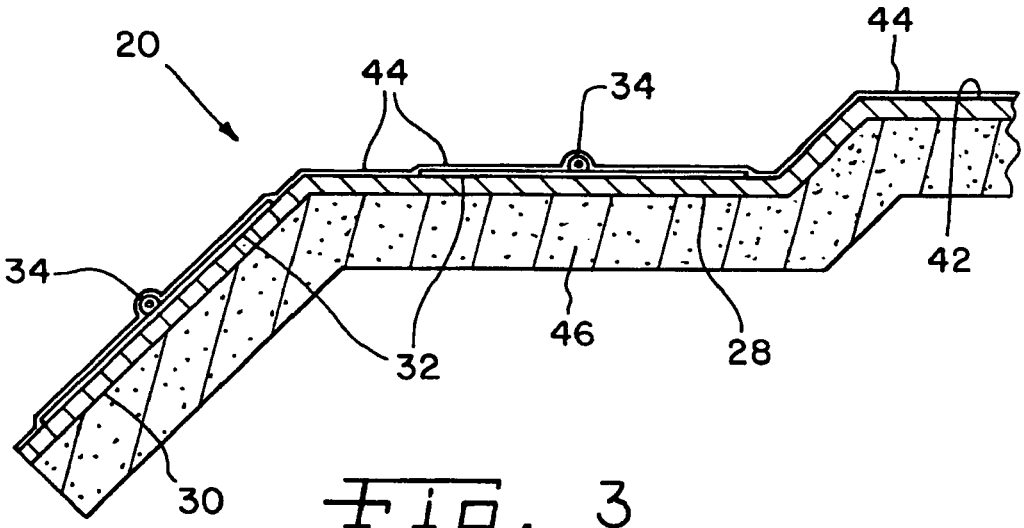
FIG. 3 is a fragmentary, sectional view taken along line 3—3 in FIG. 1.

Heater plate 20 is also mounted to mounting brackets 16, such as by using fasteners 26. Heater plate 20 is positioned under cover 18 and heats cover 18 from the bottom side thereof to melt ice and/or snow which is accumulated thereon. Heater plate 20 has a bent cross-sectional configuration, such as shown more particularly in FIGS. 2 and 3, which allows heater plate 20 to carry a plurality of heaters, as will be described in more detail hereinafter. Heater plate 20 may be a single piece of bent metal extending the expanse of the roof line, or more likely is a plurality of heater plates which are positioned in an end to end manner along the expanse of the roof line, as shown in FIG. 1.

Heater plate 20 includes a pair of adjoining angled sections 28 and 30. Angled section 28 has a top surface which lies generally parallel to the top surface of cover 18, and angled section 30 has a top surface which generally faces toward nose 24.

Each angled section 28 and 30 carries one or more adhesive foils having one side thereof with an adhesive which is adhesively bonded to the corresponding angled section 28 or 30. Each adhesive foil 32 is pre-assembled with one or more resistance heater wires 34 extending the length thereof. Resistance heater wires 34 are shown as a ridge extending the length of heater plates 20 in FIG. 2, and are shown in cross-section in FIG. 3. Resistance heater wires 34 may also be attached to heater plate 20 using other mounting techniques, such as clips or the like, but preferably are mounted to heater plate 20 using adhesive foil 32 which also tends to improve the heat transfer from resistance heater wires 34 to heater plate 20, to in turn improve the heating efficiency of the unit.

Figure 4:
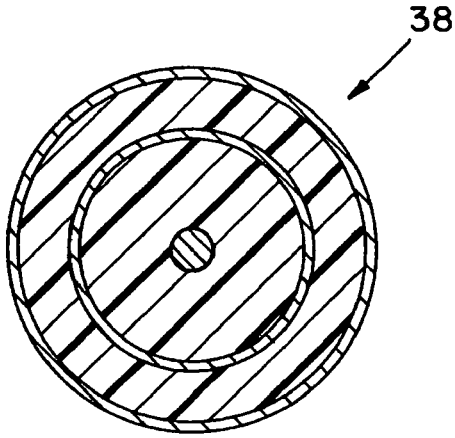
FIG. 4 is an end view of an embodiment of the triaxial cable which may be used with the gutter assembly of the present invention.

In the embodiment shown, each of resistance heater wires 34 are in the form of a single conductor, insulated heater wire which are coupled in parallel to a return cable 36 lying in gutter 14. However, resistance heater wires 34 may also be in the form of a triaxial heater cable with three concentric conductors which are spaced by intervening insulation, such as disclosed in U.S. patent application Ser. No. 10/706,005, entitled "TRIAXIAL HEATING CABLE SYSTEM", which is assigned to the assignee of the present invention and incorporated herein by reference. An example of a triaxial heater cable 38 is shown in FIG. 4.

In the embodiment shown, resistance heater wires 34 positioned in parallel to each other along heater plate 20 have a combined heat output of between approximately 10 to 20 watts per foot, and more preferably between approximately 10 to 12 watts per foot. This combined heat output has been found to provide adequate heat to cover 18 to melt any accumulation of ice and/or snow thereon.

According to another aspect of the invention, the bottom surface 40 of cover 18 and the top surface 42 of heater plate 20 are each covered with a heat absorbing material which further improves the heat efficiency of gutter assembly 10. In the embodiment shown, heat absorbing material in the form of heat absorbing coating 44 (FIG. 4) is sprayed onto the bottom surface 40 of cover 18 and the top surface 42 of heater plate 20. Coating 44 may be in the form of an infrared absorbing material such as a black infrared absorbing paint or other suitable coating. Coating 44 is preferably sprayed onto top surface 42 of heater plate 20 after each adhesive foil carrying resistance heater wires 44 has been bonded to top surface 42, thereby entirely covering the contiguous top surfaces of heater plate 20 and adhesive foils 32.

The layer of insulation 46 is positioned adjacent and preferably attached to angled sections 28 and 30 of heater plate 20. In one embodiment, insulation 46 is a layer of bubble wrap insulation having silvered reflecting surfaces on both sides (or at least the outside that is exposed to ambient air). Alternatively, the layer of insulation 46 may be in the form of a fiberglass layer which is silvered on one or both sides. Since heater plate 20 is an infrared heater, reducing spurious radiation is an important design criteria to maintain efficiency. The silvered coating on one or both sides has an extremely poor emisivity. That is, it is an extremely poor infrared radiator and prevents leakage of infrared energy.

During installation, mounting brackets 16 are attached to an existing or new gutter 14 using clips 22. The opposite end of each mounting bracket 16 is placed under an edge of the roofing material. The one or more heater plates 20 are either placed under the mounting brackets 16 prior to mounting, or are simply slid in a longitudinal direction under mounting brackets 16. The one or more heater plates 20 are fastened to mounting brackets 16 using fasteners 26. If a single heater plate 20 is used, then resistance heater wires 34 are coupled in a parallel manner to return cable 36 lying within gutter 14. If more than one heater plate 20 is used, then resistance heater wires 34 of each heater plate 20 are coupled in an end to end manner using suitable electrical joining techniques, such as splicing, connectors, etc. Cover 18 is then positioned over mounting brackets 16 and the top edge thereof is positioned under the roofing material so that water flows onto and over cover 18. Cover 18 is attached to mounting brackets 16 using suitable fastening techniques.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A gutter assembly for use on a roof, comprising:

a gutter;

a cover over said gutter, said cover including a bottom surface, said bottom surface being at least partially covered with a heat absorbing material; and a heater plate disposed under said cover, said heater plate carrying at least one heater, said heater plate having a top surface which is at least partially covered with a heat absorbing material, said heat absorbing material on each of said cover plate and said heater plate comprising an infrared absorbing material.

2. The gutter assembly of claim 1, wherein said heater plate has a top surface and each said heater is positioned on said top surface.

3. The gutter assembly of claim 1, wherein said at least one heater comprises at least one resistance heater wire.

4. A gutter assembly for use on a roof, comprising:

a gutter;

a cover over said gutter, said cover including a bottom surface, said bottom surface being at least partially covered with a heat absorbing material;

a heater plate disposed under said cover, said heater plate carrying at least one heater, said at least one heater being at least one resistance heater wire; and at least one adhesive foil, each said adhesive foil mounting a corresponding said heater wire to said heater plate.

5. The gutter assembly of claim 3, wherein said at least one resistance heater wire comprises two resistance heater wires positioned generally parallel to each other and extending along a length of said heater plate.

6. The gutter assembly of claim 5, wherein said resistance heater wires provide a heat output of between approximately 10 to 20 Watts/linear foot.

7. The gutter assembly of claim 3, wherein each said resistance heater wire comprises a triaxial heater wire.

8. The gutter assembly of claim 1, wherein said gutter assembly includes a plurality of heater plates positioned in an end to end relationship to each other.

9. The gutter assembly of claim 1, further including at least one mounting bracket, and each of said cover and said heater plate are mounted to each said mounting bracket.

10. The gutter assembly of claim 1, wherein said heater plate has a top surface and a bottom surface, each said heater being positioned on said top surface, and further including a layer of insulation positioned adjacent said bottom surface.

11. The gutter assembly of claim 10, wherein said layer of insulation includes a silvered reflecting surface on at least one side thereof.

* * * * *